United States Patent [19]

Rizzo, Jr.

[11] Patent Number: 4,793,061

[45] Date of Patent: Dec. 27, 1988

[54] TICKET SCRAPER

[76] Inventor: Joseph A. Rizzo, Jr., 739 East St., Southington, Conn. 06489

[21] Appl. No.: 102,098

[22] Filed: Sep. 29, 1987

[51] Int. Cl.[4] ..... B26B 3/00

[52] U.S. Cl. ..... 30/169; 15/236.01

[58] Field of Search ..... 30/129, DIG. 3, 278, 30/280; 15/236 R

[56] References Cited

U.S. PATENT DOCUMENTS

| | | | |
|---|---|---|---|
| 2,753,105 | 7/1956 | Werner et al. | 30/2 X |
| 2,815,572 | 12/1957 | Deicken | 30/DIG. 3 |
| 4,360,970 | 11/1982 | Ostroski et al. | 30/DIG. 3 |
| 4,646,382 | 3/1987 | Smith | 15/236 R |

*Primary Examiner*—Douglas D. Watts

*Attorney, Agent, or Firm*—McCormick, Paulding & Huber

[57] ABSTRACT

A lottery ticket scraper has a body and a resilient scraper element supported in cantilever position on the body. The body and scraper element cooperate to define a ticket receiving slot through which a ticket may pass. A scraping edge on the scraper element and disposed within the slot is movable into scraping engagement with the surface of a lottery ticket inserted into the slot in response to squeezing pressure applied to the body and the scraper element so that a removable coating may be scraped from the surface of the ticket by pulling the ticket through the ticket scraper.

7 Claims, 1 Drawing Sheet

TICKET SCRAPER

BACKGROUND OF THE INVENTION

This invention relates in general to scrapers and deals more particularly with an improved device for scraping a removable opaque coating from a surface of a lottery ticket or other game playing card to expose printed material on the surface of the ticket or card.

Many states presently operate instant lottery games which utilize lottery tickets or cards partially coated with removable opaque material which covers numbers or symbols imprinted on the surface of the ticket. At least some of the removable material must be scraped from the ticket surface to expose the numbers or symbols which provide instant indication as to whether the ticket is a winner. The coating material may be scraped from the ticket using a coin or like implement and in some instances a thumbnail may be used for this purpose. Such lottery tickets are often sold at the check out counters of food stores and restaurants to attract impulse buyers who usually wish to immediately determine if they have purchased a winning ticket.

It is the general aim of the present invention to provide a compact, lightweight, durable ticket scraper for manufacture at low cost and distribution in the the same channels of trade in which lottery tickets are usually sold.

SUMMARY OF THE INVENTION

In accordance with the present invention, a ticket scraper is provided which comprises a body element and a resilient scraper element supported on the body element for movement relative to the body element. The body element and the scraper element cooperate to define a ticket receiving slot through which a ticket may pass. One of the elements which include the body and scraper elements defines a scraping edge. The other of the elements defines a ticket supporting surface disposed in opposing relation to the scraping edge. The scraping edge is movable into scraping engagement with the surface of a ticket inserted in the slot in response to pressure applied to the scraper element in the direction of the body element. A guide means is also provided for directing movement of the ticket along a predetermined path as it is pulled through the ticket receiving slot.

DETAILED DESCRIPTION OF PREFERRED EMBODIMENT

Figure 1:
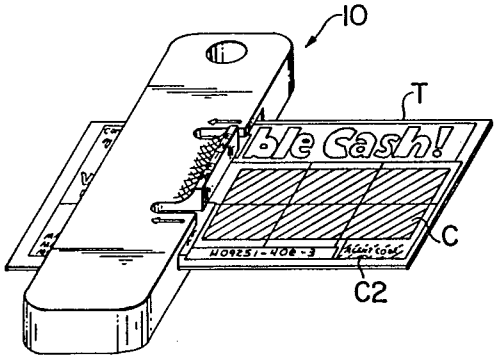
FIG. 1 is a perspective view of a ticket scraper embodying the present invention and shown with a lottery ticket positioned therein.

Turning now to the drawing, a lottery ticket scraper embodying the present invention and indicated generally by the reference numeral 10 is shown in FIG. 1 with a lottery ticket T positioned therein.

Figure 2:
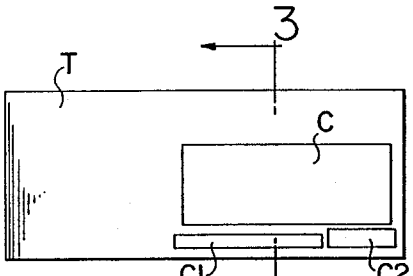
FIG. 2 is a plan view of the lottery ticket shown in FIG. 1.
Figure 3:
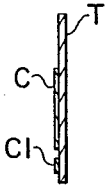
FIG. 3 is a sectional view taken along the line 3—3 of FIG. 2.
Figure 4:
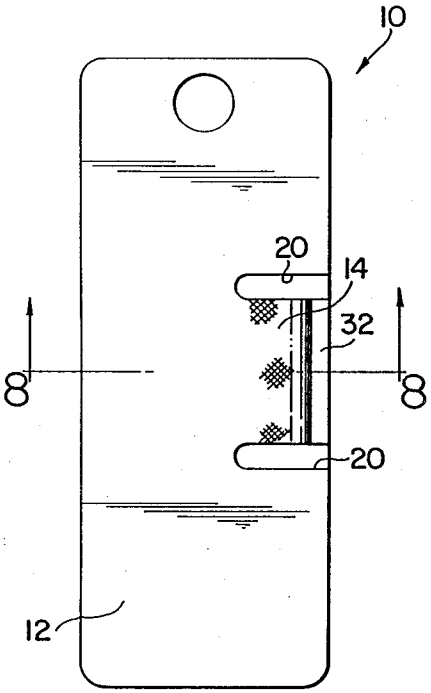
FIG. 4 is a top view of the ticket scraper of FIG. 1.

The illustrated lottery ticket T, further shown in FIGS. 2 and 3, is typical of tickets used in the lottery games promoted and/or operated by many states. It is generally rectangular, made from heavy paper stock, and has lottery numbers or symbols imprinted on one of its surfaces. A serial number is usually imprinted on the ticket to aid in ascertaining the validity of the ticket. The ticket may also be imprinted with a numerical code or the like to indicate the identity of the issuing agent. An opaque coating of removable material overlies a portion of the ticket surface and covers at least the lottery numbers or symbols. In some instances the removable coating material may cover the serial number of the ticket, as indicated at C, and also the code which identifies the issuing agent, as designated at C2 (FIGS. 1-3). The lottery numbers are usually imprinted on a central portion of the ticket, whereas the serial number and identifying code are ordinarily imprinted along or near a marginal portion of the ticket. Lottery playing cards of the type with which the present invention is concerned are illustrated and described in U.S. Pat. No. 4,191,376 to Goldman, et al for Highly Secure Playing Cards for Instant Lottery and Games, issued Mar. 4, 1980 and assigned to Systems Operations, Inc., Princeton, New Jersey and U.S. Pat. No. 4,398,708 to Goldman, et al for Method of Fabricating and Securing Playing Cards for Instant Lotteries and Games, issued Aug. 16, 1983. The aforesaid two patents to Goldman, et al are hereby adopted by reference as part of the present disclosure.

Considering now the scraper 10 in further detail, it is generally rectangular, preferably comprises a unitary structure made from durable, lightweight, resilient plastic material and includes a body element 12 and a scraper element 14 supported on the body element for movement relative to the body element and generally toward and away from it. The body and scraper elements 12 and 14 cooperate to define a ticket receiving slot indicated at 16 and through which a ticket may pass. The width of the ticket receiving slot 16 is substantially equal to the width of an associated lottery ticket T. The opposite sides of the slot are defined by opposing side walls 18,18, at least portions of which are parallel to each other for guiding a lottery ticket, such as the ticket T, along a predetermined path through the ticket receiving slot 16.

A pair of laterally spaced apart slits 20,20 through the upper portion of the body element 12, as it appears oriented in the drawing, are spaced laterally inwardly from the opposite side walls 18,18 and extend inwardly from the front or ticket receiving end of the body element 12. The slits 20,20 separate the scraping element 14 from the body element 12 so that the scraper element 14 is supported in cantilever position on the body element generally centrally of the ticket receiving slot 16 for resilient hinged movement generally toward and away from the bottom wall of the slot, the latter wall being indicated by the numeral 22.

Figure 8:
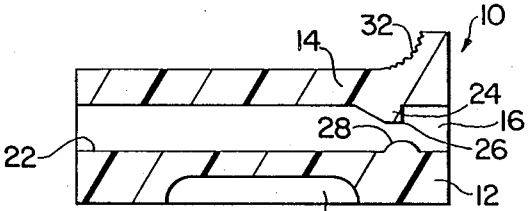
FIG. 8 is a somewhat enlarged sectional view taken along the line 8—8 of FIG. 4.

A laterally extending scraping member 24 integrally connected to the scraper element 14 depends from the scraper element within the slot 16 and defines a laterally extending scraping edge 26 which is preferably spaced rearwardly of the forward edge of the scraper element 12, as shown in FIG. 8.

A laterally extending ticket supporting rib 28 projects upwardly from the slot bottom wall 22 in generally opposing relation to the scraping edge 26. Preferably, and as shown, the rib 28 extends along only a portion of the lateral width of the slot 16 below the scraping member 24.

Figure 5:
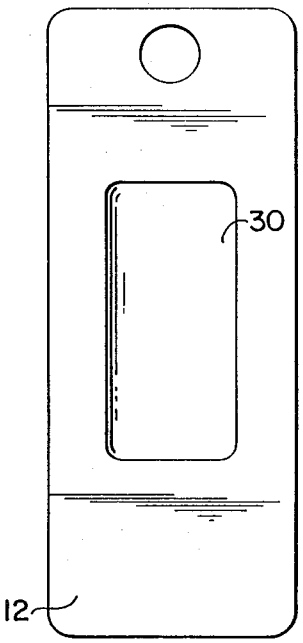
FIG. 5 is a bottom view of the ticket scraper.
Figure 6:
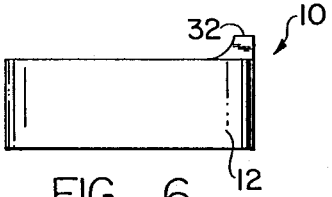
FIG. 6 is a side elevational view of the ticket scraper.
Figure 7:
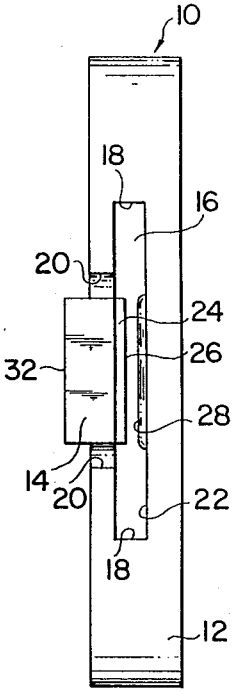
FIG. 7 is an entry end view of the ticket scraper.

A recess 30 opens downwardly through the lower surface of the body element 12, as best shown in FIGS. 5 and 8. The ticket scraper 10 also has a finger piece 32 which projects upwardly from the upper surface of the scraper element 14 and extends along the forward end portion of the scraper element, substantially as shown.

The scraping edge 26 is located relative to the slot side walls 18,18 to engage and scrape at least a portion of the removable coating which covers the lottery numbers or symbols on the ticket T which determine whether or not the ticket is a winning one. That portion of the coating which covers the ticket serial number or other validation markings on the ticket passes through an end portion of the slot 16 outward the scraping edge 26 and is not engaged by the scraping edge so that the serial number or other validation marking on the ticket remains concealed by the opaque covering material after the lottery numbers or symbols on the ticket surface are exposed.

A ticket such as the ticket T is inserted into the forward or entry end of the slot 16 whereupon the ticket scraper 10 is grasped with the thumb disposed within the recess 30 and a finger or fingers engaging the finger piece 32. Light squeezing pressure is applied to the device as the ticket is pulled through the slot 16 which scrapes the removble coating from a portion of the ticket surface exposing the lottery numbers or symbols which indicate whether the ticket is a winning one.

I claim:

1. A device for scraping removable coating material from a portion of the surface of a generally rectangular ticket having one area of coating material spaced inward of the laterally opposite longitudinally extending marginal portions of the ticket and another area of coating on one of the longitudinally extending marginal positions, said device comprising a unitary structure made of resilient plastic material having a scraper body and a scraper element integrally connected in cantilever position to said scraper body, the free end portion of said scraper element being movable toward said scraper body in response to squeezing pressure applied to said scraper element and said scraper body, said scraper element and said scraper body cooperating to define a ticket receiving slot through which said ticket is free to pass, said slot having a width substantially equal to the width of said ticket and including laterally opposed parallel end wall portions for guiding a ticket along a predetermined path through said slot, said scraper element having a depending part disposed within said slot and defining a generally rectilinear laterally extending scraping edge, said scraping edge having a width of substantially lesser extent than the width of said slot and being laterally inwardly spaced from said end walls, said scraper body having a laterally extending and upwardly projecting rib thereon disposed within said slot in opposing relation to said scraping edge, said scraping edge cooperating with said rib to scrape the removable coating material from the one area when the portion of the ticket including the one area is moved through said slot while squeezing pressure is applied to said scraping element and said scraping surface to maintain said scraping edge in scraping engagement with the coated surface of the ticket.

2. A ticket scraper for removing coating material from a surface of a ticket and comprising a unitary structure made from resilient material and including a scraper body and a scraper element resiliently hingedly supported at its rear end in cantilever position on said scraper body and cooperating with said scraper body to define a ticket receiving slot extending from front to rear through said ticket scraper, said slot having a top wall, a bottom wall and a pair of laterally opposed side walls, a laterally extending scraper member integrally connected to and depending from said scraper element within said slot in rearwardly spaced relation to the front end of said scraper element, a laterally extending ticket supporting rib projecting upwardly from said bottom wall in opposing relation to said scraping member, said scraper element being movable toward said bottom wall and to a ticket scraping position in response to squeezing pressure applied to said scraper element and said scraper body, said scraping member cooperating with said ticket supporting rib in said scraping position to engage opposite sides of a ticket disposed within said slot between said scraping member and said ticket supporting rib to scrape coating material from the ticket when the ticket is pulled through said slot while squeezing pressure is applied to said scraper element and said scraper body to maintain said scraping member in scraping engagement with the coating material on the surface of the ticket.

3. A ticket scraper for removing coating material from a surface of a ticket and comprising a unitary generally rectangular block shaped structure made from resilient plastic material and including a body element and a scraper element resiliently hingedly supported at its rear end in cantilever position on said body element and extending forwardly therefrom, said scraper element cooperating with said body element to define a ticket receiving slot extending from front to rear through said ticket scraper, said slot having a bottom wall and a pair of laterally opposed side walls defined by said body element, said slot having a top wall partially defined by said scraper element and further defined by said body element, said scraper element being separated from said body element by a pair of laterally spaced apart slits defined by said body element and said scraper element and communicating with said slot, a laterally extending scraping member integrally connected to the lower surface of said scraper element and depending therefrom within said slot in rearwardly spaced relation to the front end of said scraper element, a laterally extending ticket supporting rib projecting upwardly from said bottom wall and having an upper surface disposed above said bottom wall in opposing relation to said scraping member, said scraper element being movable toward said bottom wall and to a ticket scraping position in response to squeezing pressure applied to said scraper element and said body element, said scraping member cooperating with said upper surface of said ticket supporting rib in said scraping position to engage opposite sides of a ticket disposed within said slot and between said scraping member and said ticket supporting rib to scrape coating material from the ticket when the ticket is pulled through said slot while squeezing pressure is applied to said scraper element and said body element to maintain said scraping member in scraping engagement with the coating material on the surface of the ticket.

4. A ticket scraper as set forth in claim 15 wherein the width of said slot is substantially equal to the width of the ticket and said side walls comprise means for guiding said ticket along a predetermined path through said slot.

5. A ticket scraper as set forth in claim 2, wherein said body element has a thumb receiving recess therein.

6. A device as set forth in claim 5 wherein said thumb recess opens through the lower surface of said scraper body.

7. A device as set forth in claim 5 including a finger rest projecting upwardly from said scraper element near the front end thereof.

* * * * *